US007431235B2

(12) United States Patent
Moritz

(10) Patent No.: US 7,431,235 B2
(45) Date of Patent: Oct. 7, 2008

(54) UTILITY STRAP DISPENSER

(76) Inventor: Joel M. Moritz, 110 N. Boxelder St., Norfolk, NE (US) 68701

( * ) Notice: Subject to any disclaimer, the term of this patent is extended or adjusted under 35 U.S.C. 154(b) by 0 days.

(21) Appl. No.: 11/882,030

(22) Filed: Jul. 30, 2007

(65) Prior Publication Data

US 2007/0267530 A1 Nov. 22, 2007

Related U.S. Application Data

(63) Continuation-in-part of application No. PCT/US2005/043082, filed on Dec. 1, 2005, and a continuation-in-part of application No. 11/028,557, filed on Jan. 5, 2005, now Pat. No. 7,249,729.

(51) Int. Cl.
*B65H 16/00* (2006.01)

(52) U.S. Cl. ..... 242/588.6; 242/395; 242/397; 242/615.3; 242/912

(58) Field of Classification Search ..... 242/395, 242/395.1, 397, 405, 588.6, 615.3, 912
See application file for complete search history.

(56) References Cited

U.S. PATENT DOCUMENTS

| | | | | |
|---|---|---|---|---|
| 1,154,212 | A | 9/1915 | Schloss | |
| 2,589,192 | A | 3/1952 | Johnston | |
| 2,706,592 | A | 4/1955 | Schaller | |
| 2,844,334 | A | 7/1958 | Luth | |
| 3,115,243 | A | 12/1963 | Nash | |
| 3,149,719 | A | 9/1964 | Thompson et al. | |
| 3,627,118 | A | 12/1971 | Daggs | |
| 3,810,588 | A | 5/1974 | Mahoney | |
| 3,971,280 | A | 7/1976 | Inka | |
| 4,266,738 | A | 5/1981 | Nakagawa | |
| 4,396,165 | A | 8/1983 | Bates et al. | |
| 5,284,247 | A | 2/1994 | Turner | |
| 5,370,332 | A | 12/1994 | Goff et al. | |
| 5,623,802 | A | 4/1997 | Boushek et al. | |
| 6,561,452 | B2 | 5/2003 | Adams | |
| 6,712,310 | B2 | 3/2004 | Adams | |
| 7,249,729 | B2 * | 7/2007 | Moritz | 242/588.6 |
| 2002/0166919 | A1 | 11/2002 | Adams | |
| 2002/0179174 | A1 | 12/2002 | Marsche | |
| 2003/0132338 | A1 | 7/2003 | Adams | |

FOREIGN PATENT DOCUMENTS

| | | |
|---|---|---|
| EP | 1260441 | 12/2002 |

* cited by examiner

*Primary Examiner*—William A Rivera
(74) *Attorney, Agent, or Firm*—Richard C. Litman

(57) ABSTRACT

The utility strap dispenser is a container having a top plate and a bottom plate with central mounting apertures. A cylindrical wall having a dispensing slot is provided on an upper surface of the bottom plate defining a chamber for receiving a coil of strap material and a peripheral flange upon the bottom plate. The legs of a metal or plastic split pin pass through the central mounting apertures straddling an inner end of a coil of strap material and secure the container plates together while mounting the coil of strap material for rotation within the container. A guide stop having a guide slot for the passage of the free end of the strap material is provided on the outer surface of the cylindrical wall a predetermined distance from the dispensing slot.

12 Claims, 11 Drawing Sheets

UTILITY STRAP DISPENSER

CROSS-REFERENCE TO RELATED APPLICATIONS

This application is a continuation-in-part of U.S. patent application Ser. No. 11/028,557, filed Jan. 5, 2005 now U.S. Pat. No. 7,249,729, and of International patent application serial no. PCT/US2005/043082, filed Dec. 1, 2005.

FIELD OF THE INVENTION

The present invention relates to containers for storing and dispensing coiled flat strap materials such as strips, tapes, webs and the like. More particularly, the present invention relates to a container for storing and dispensing selective lengths of coiled utility strap material that can be suspended or carried by the free end of the strap material.

SUMMARY OF THE INVENTION

The utility strap dispenser is a container, preferably for storing and dispensing selective lengths of coiled utility strap material. The container is formed with a round top plate having a central mounting aperture and a round bottom plate provided with a central mounting aperture. A concentrically arranged cylindrical wall is either formed on or secured onto an upper surface of the bottom plate with an outer surface of the wall positioned adjacent the peripheral edge of the bottom plate defining a coil-receiving chamber and a peripheral flange on the bottom plate. The top plate rests upon a top edge of the cylindrical wall and closes the coil-receiving chamber of the container.

In some embodiments, the legs of a metal split pin are passed through the central mounting apertures in the top and bottom plates to straddle an inner end of the coiled material. The free ends of the legs are bent back against the top surface of the top plate to secure the container plates together and mount the coil of strap material for rotation within the chamber of the container. A slot is provided through the cylindrical wall for dispensing the strap material from the container.

A curved guide stop is either formed on or mounted onto the outer surface of the cylindrical wall spaced a predetermined distance from the dispensing slot. The curved guide stop includes an upper end having a guide slot for the passage of the free end of the strap material and a lower end secured to the outer surface of the cylindrical wall.

When the free end of strap material is held and the container let fall free under the force of gravity, the strap material frictionally binds itself in the guide slot of the guide stop so that the container may be suspended by the free end of the strap material for convenient use, storage or transport of the container without releasing unwanted lengths of strap material from the coil within the container.

In other embodiments, the split pin need not be made of metal, but may be made from plastic by injection molding or other manufacturing processes. The split pin may have arcuate ridges or "bumps" on opposite sides of the shaft just below the head that form a snap fit or interference fit to keep the pin attached to the bottom plate of the container. The distal end of the shaft of the split pin may have an annular groove defined therein adjacent the end of the shaft. The groove defines a lower shoulder that prevents the top plate from falling too far into the container and an upper shoulder that retains the top plate on the pin to cover the container.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
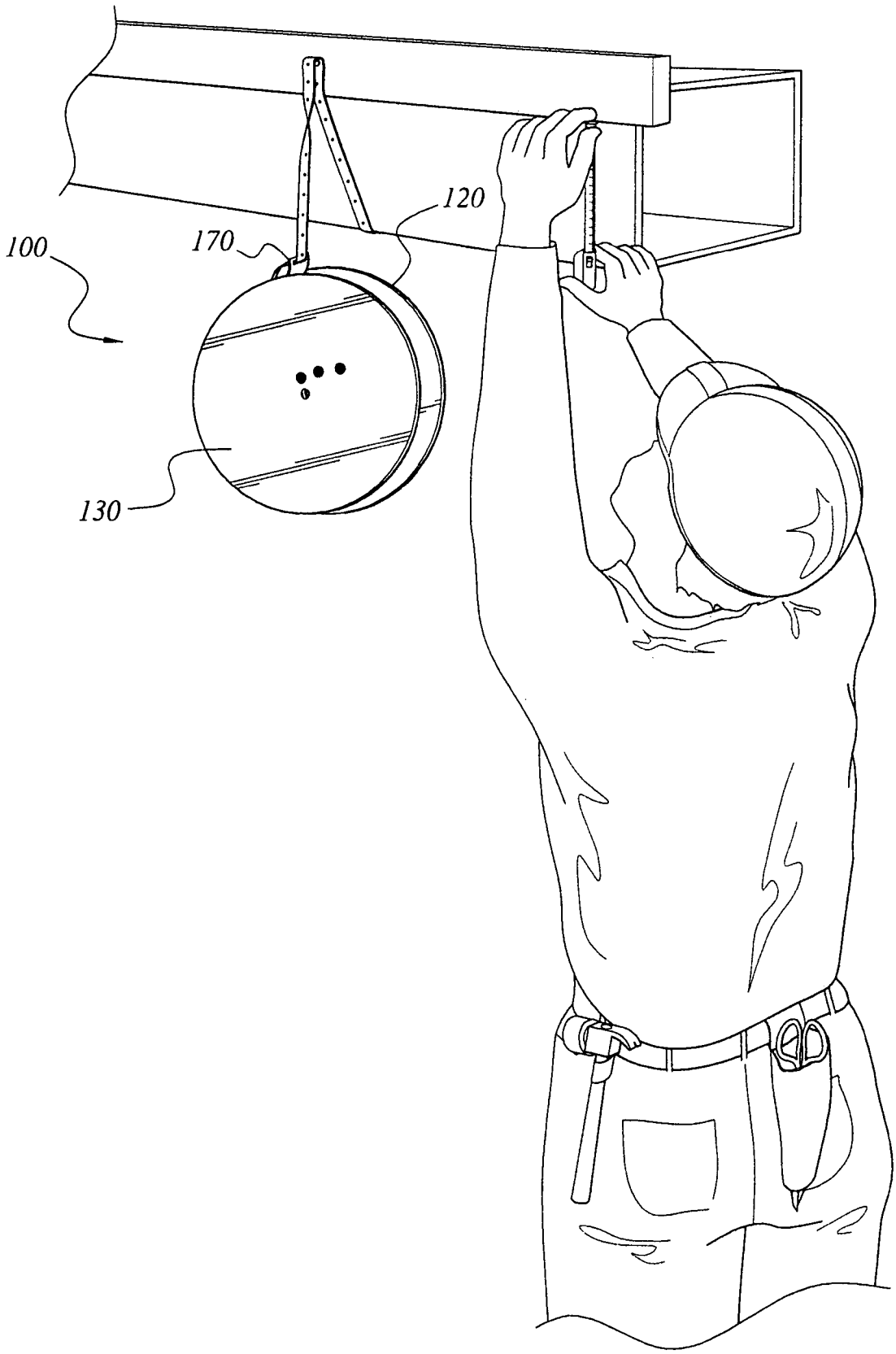
FIG. 1 is an environmental, perspective view of a utility strap dispenser according to the present invention.
Figure 2:
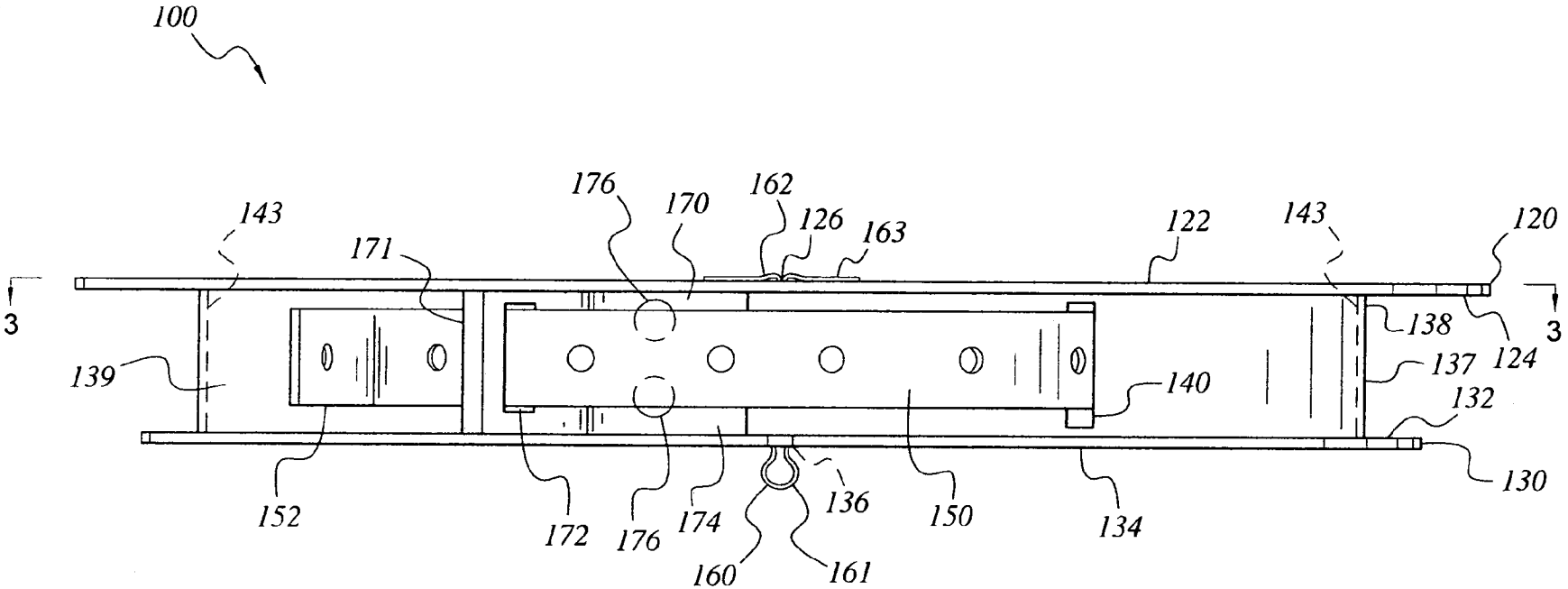
FIG. 2 is a side view of the utility strap dispenser according to the present invention.
Figure 3:
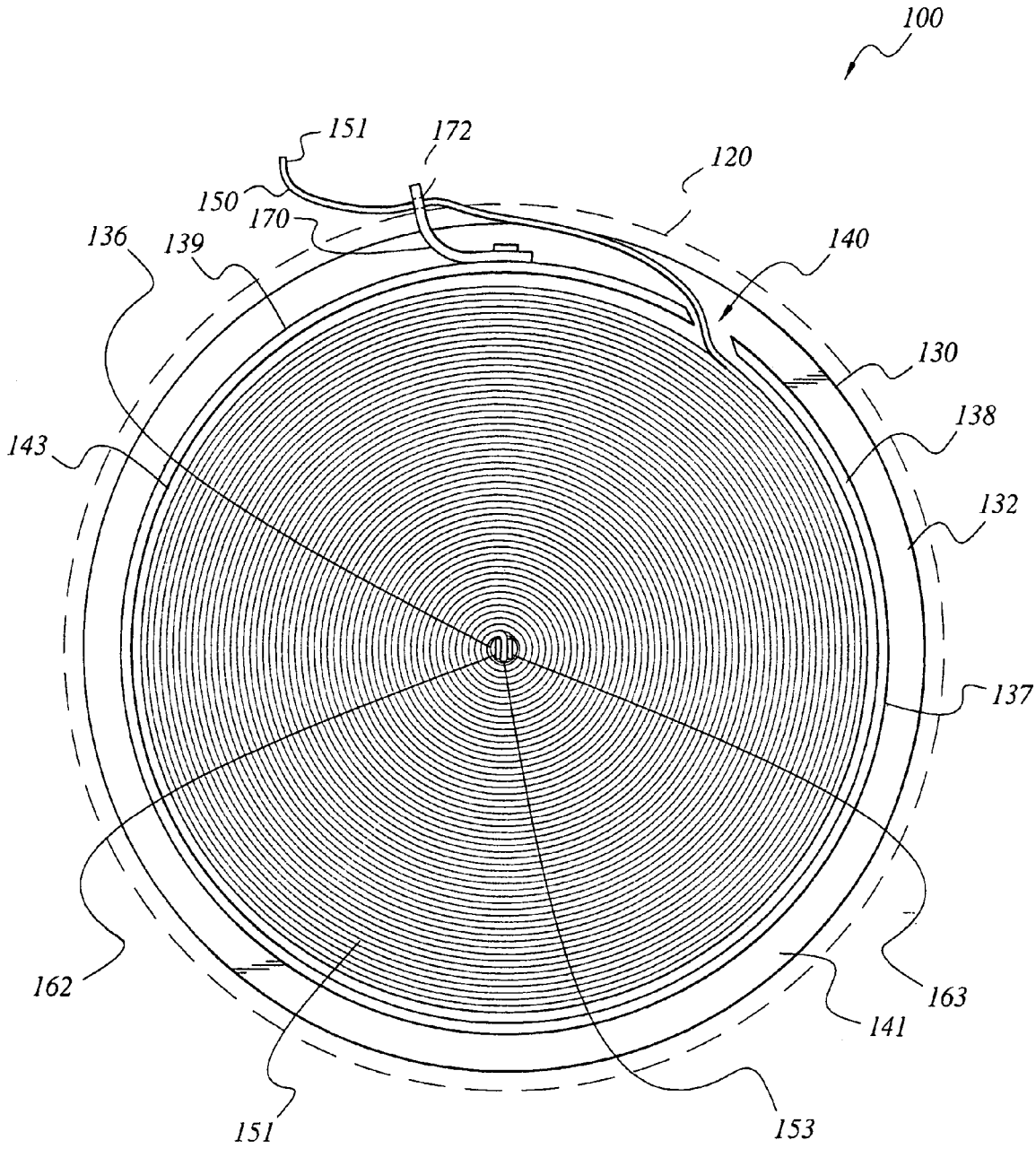
FIG. 3 is a section view drawn along lines 3-3 of FIG. 2.
Figure 4:
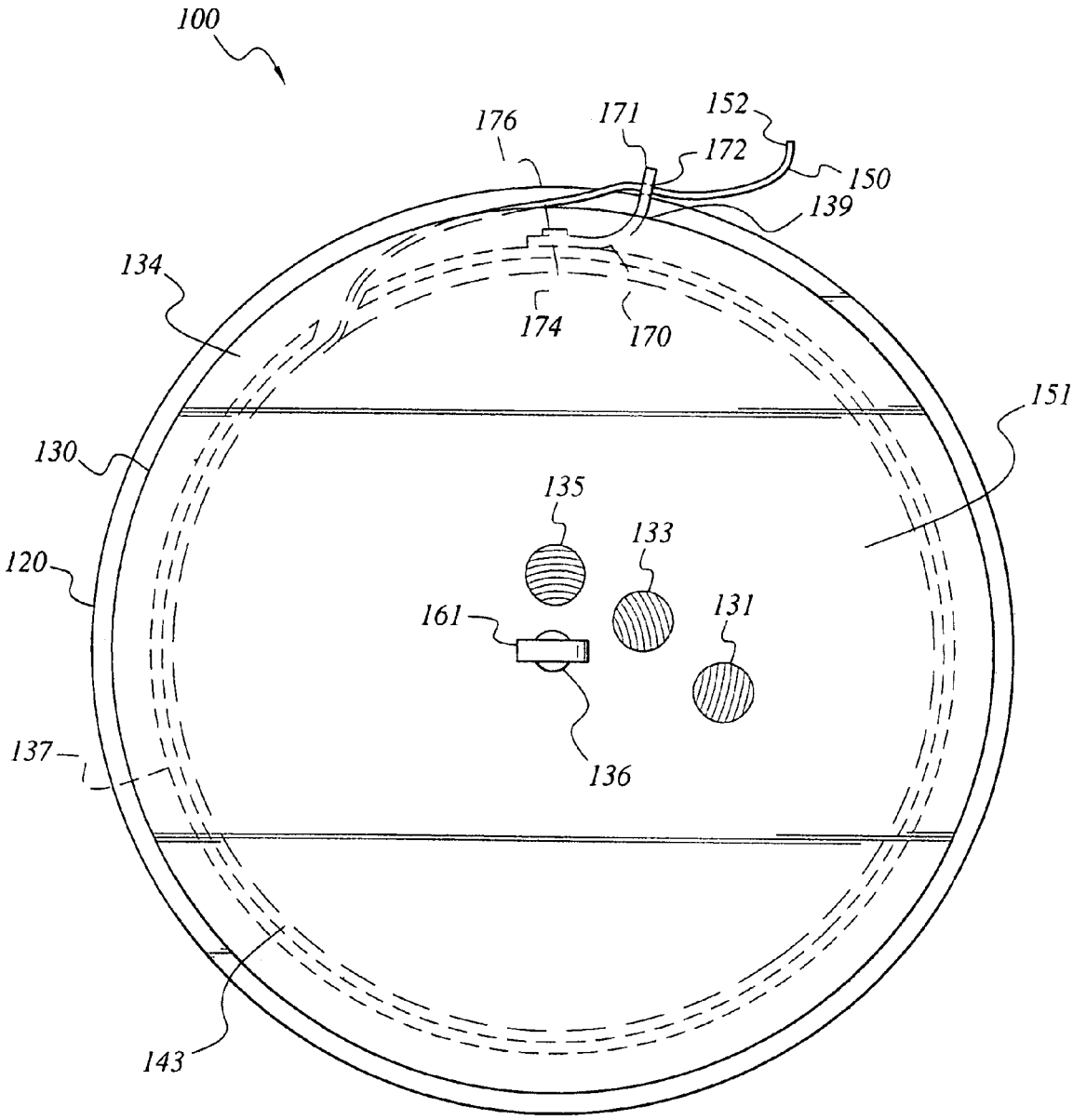
FIG. 4 is a bottom view of the utility strap dispenser according to the present invention.
Figure 5:
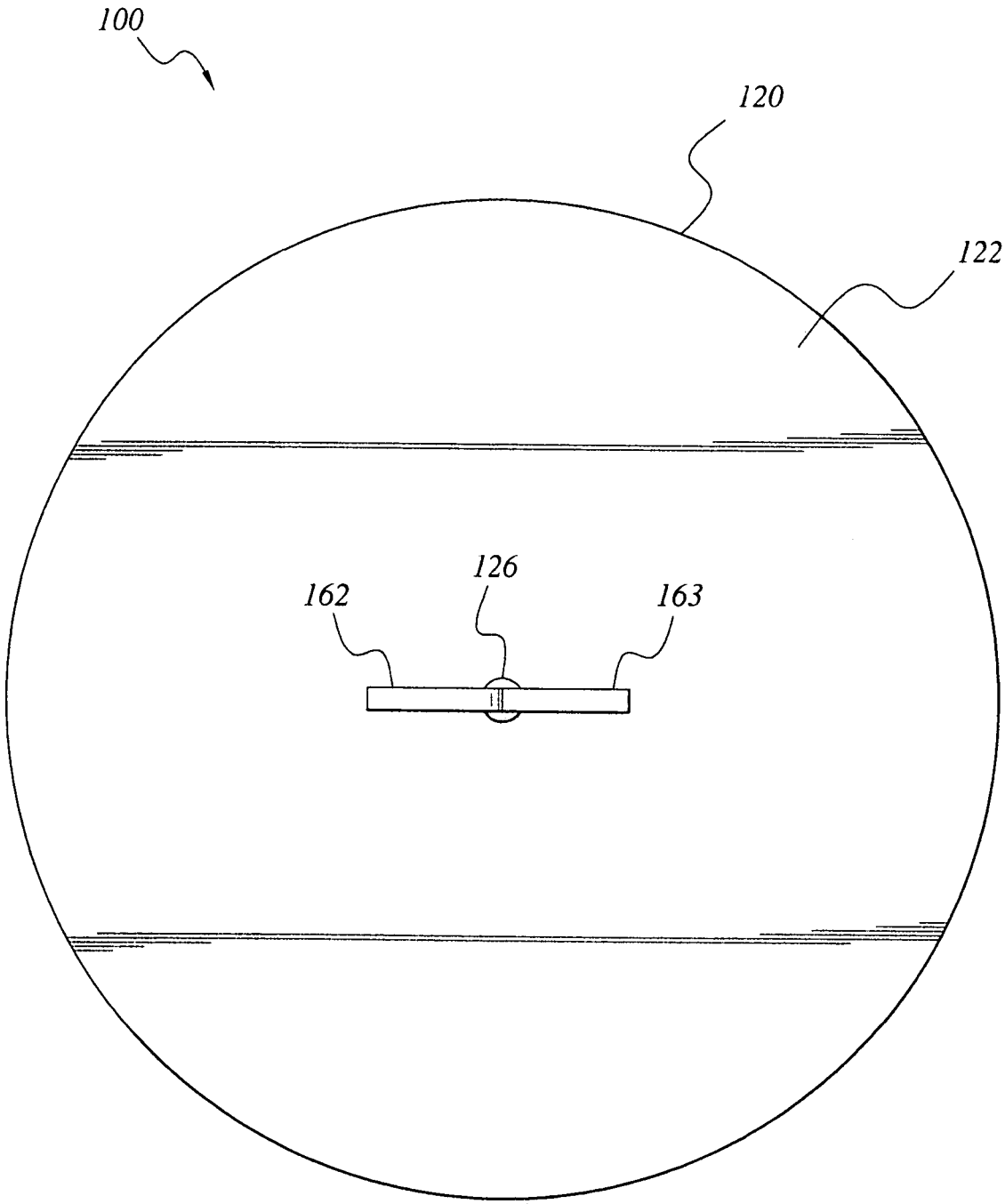
FIG. 5 is a top view of the utility strap dispenser according to the present invention.

The present invention is a container 100, preferably for storing and dispensing selective lengths of strap material formed into a coil 151. Coiled strap materials suitable for dispensing from container 100 are commercially available in a variety of sizes that are used, for example, in the HVAC (Heating Ventilation and Air Conditioning) and plumbing industries, such as the metal or plastic hanger, pipe, and webbing straps of the BRAMEC company U.S.A. Container 100 may also suitably dispense commercially available foam insulating window strips.

As shown in FIGS. 2 through 5, the container 100 is formed with a round top plate 120 having a central mounting aperture 126 and a round bottom plate 130 provided with a central mounting aperture 136. A concentrically arranged cylindrical wall 137 is either formed on or secured onto an upper surface 132 of the bottom plate 130 adjacent the peripheral edge of the bottom plate 130, defining a coil-receiving chamber 143 for receiving a coil of strap material 151, and defining a peripheral flange 141 formed by the portion of the bottom plate 130 extending beyond the cylindrical wall 137. The top plate 120 rests upon a top edge 138 of the cylindrical wall 137, closing the coil-receiving chamber 143 of the container 100.

A metal split pin 160 includes an enlarged head 161, a first leg 162 and a second leg 163. The head 161 is larger than mounting aperture 136 in bottom plate 130. Legs 162, 163 of split pin 160 are passed through the central mounting aperture 136 in bottom plate 130 and straddle an inner end 153 of the coil 151 of strap material. The free ends of the first leg 162 and second leg 163 are passed through the central mounting aperture 126 of top plate 120 and bent back against the top surface 122 of the top plate 120 to secure top plate 120 and bottom plate 130 of container 100 together and mount the coil 151 of strap material for rotation within the coil-receiving chamber 143 of the container 100. A slot 140 is provided through the cylindrical wall 137 for dispensing the strap material 150 from the container 100.

Figure 7:
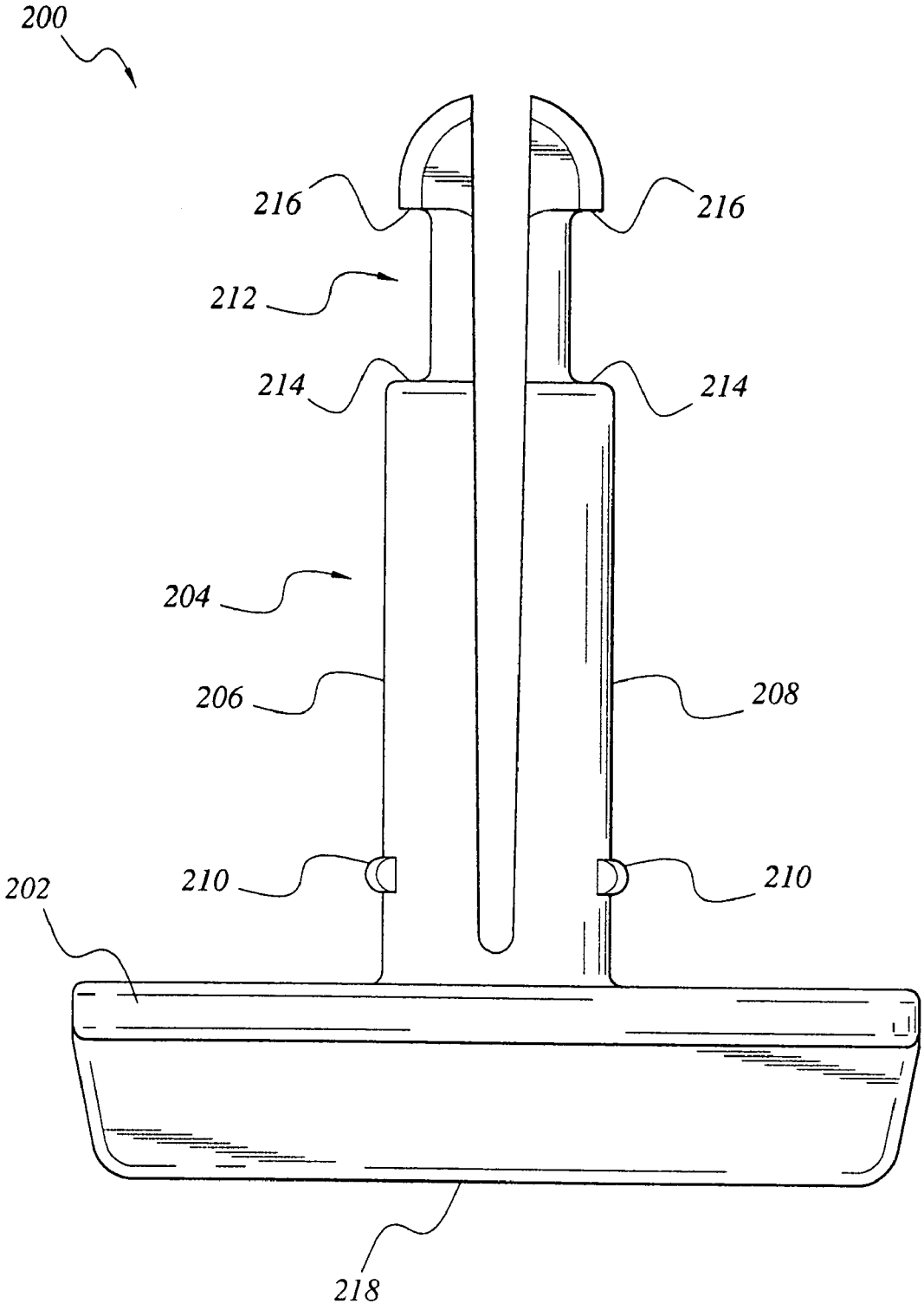
FIG. 7 is a side view of an alternative embodiment of a split pin for the utility strap dispenser according to the present invention.
Figure 8:
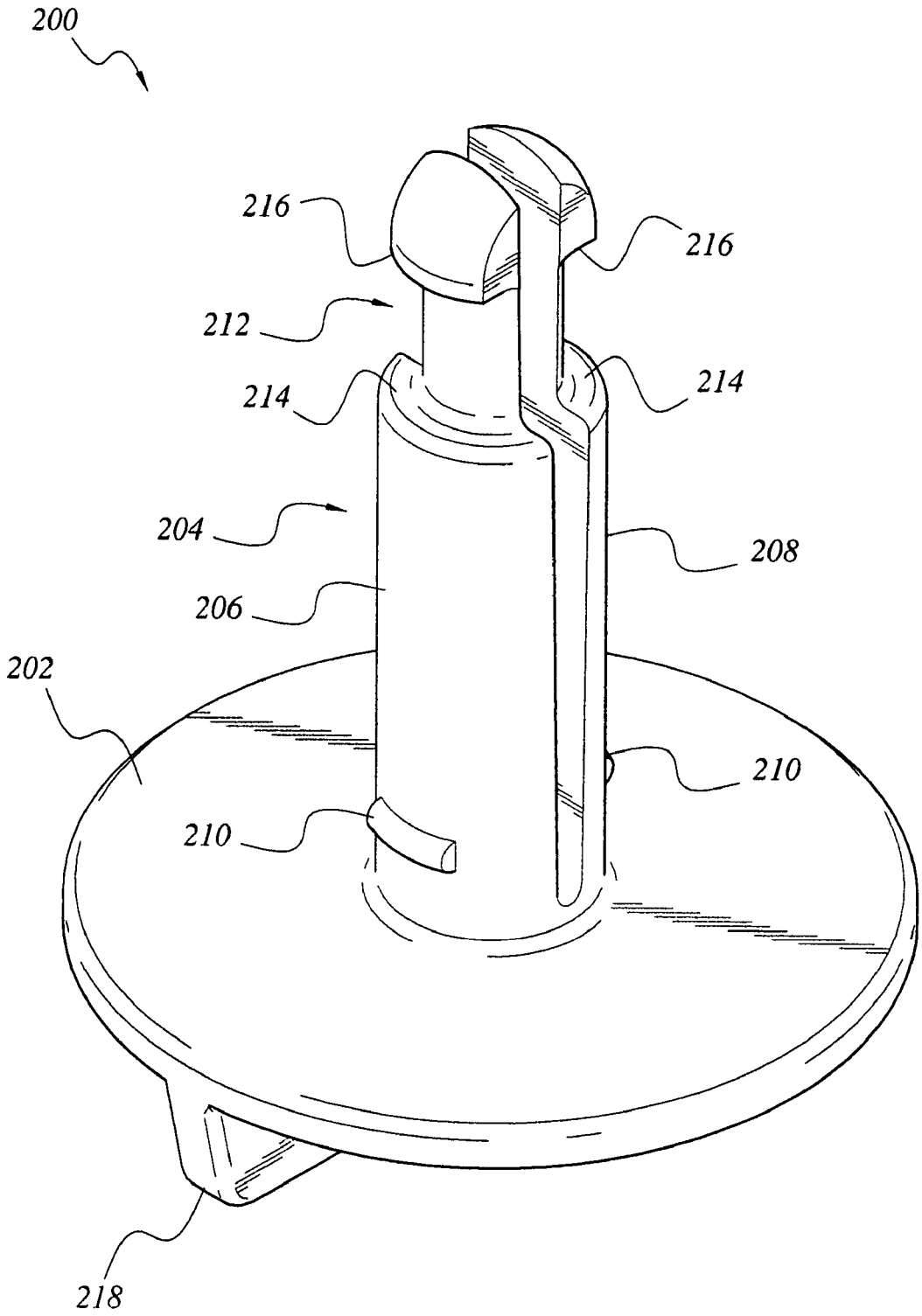
FIG. 8 is a perspective view of the split pin of FIG. 7 as viewed from the end of the shaft.
Figure 9:
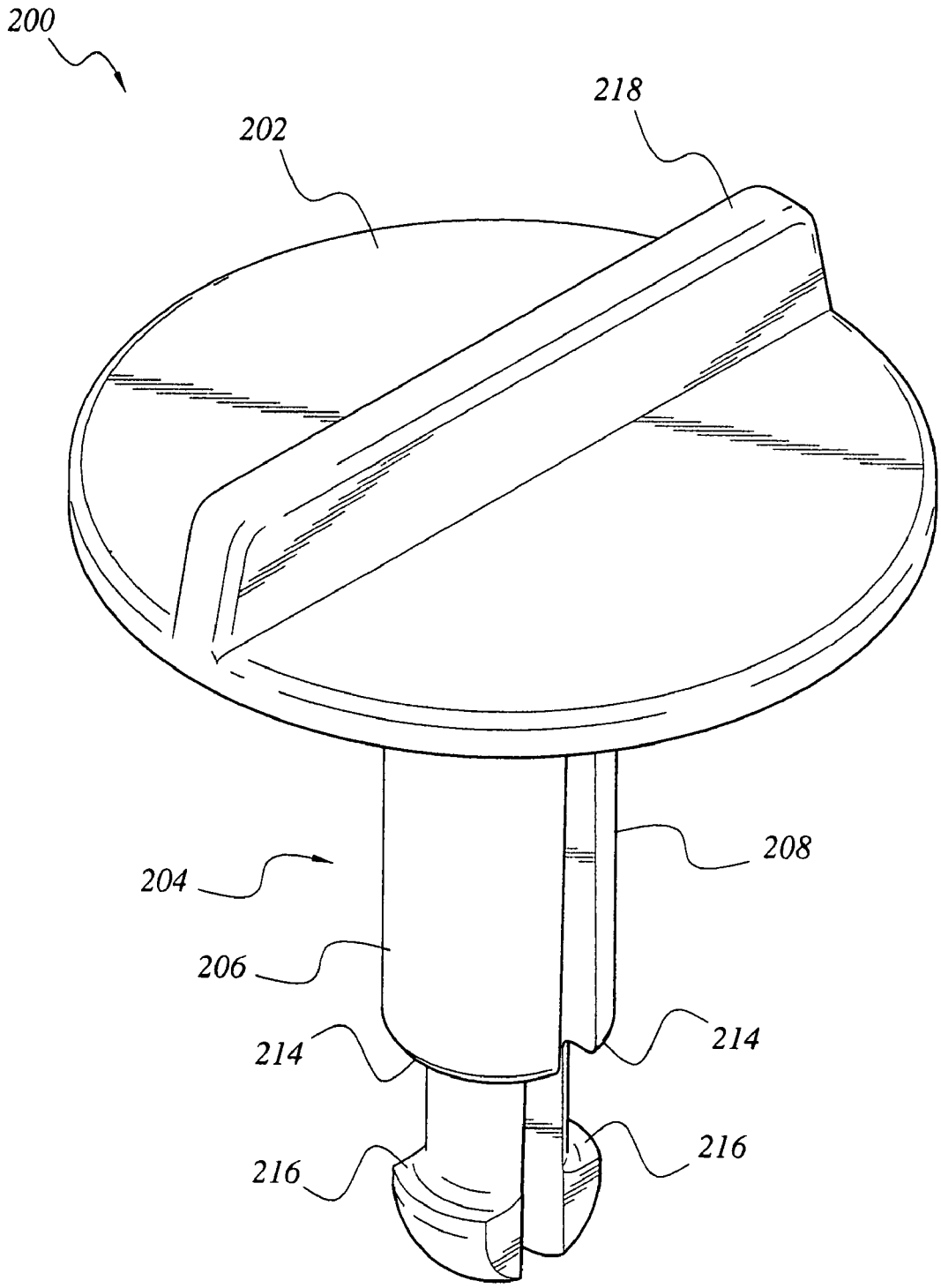
FIG. 9 is a perspective view of the split pin of FIG. 7 as viewed from above the head of the pin.

Referring to FIGS. 7-9, an alternative to the metal split pin 160 is shown. Split pin 200, which may be plastic and made by injection molding or other plastic manufacturing processes, has a head 202 larger in diameter than central apertures 126 and 136, and a split shaft 204 defining legs 206 and 208. Each of the legs 206 and 208 is provided with an arcuate ridge 210 or "bumps" adjacent the head 202 to keep the split pin 200 attached to the bottom plate 130 of the container 100. An annular groove 212 is defined in the split shaft 204 adjacent the distal end of the shaft 204. The groove 212 defines a lower shoulder 214 on legs 206 and 208 that serves as a stop to prevent the top plate 120 from collapsing too far into coil-receiving chamber 143, which might prevent rotation of the coil 151. The groove 212 also defines an upper shoulder 216 on legs 206 and 208 to retain the top plate 120 to cover the container 100. The legs 206 and 208 may be resilient enough that legs 206 and 208 can be compressed towards each other enough for insertion through apertures 136 and 126, but expand away from each other after insertion to retain bottom plate 130 and top plate 120 in proper alignment. The head 202 may be provided with a handle 218, e.g., a bar extending diametrically across the head 202 of the pin 200, in order to rotate the pin 200 to dispense an increment of strap 150 from the coil 151, the split legs 206 and 208 being gripping an end of the coil 151 there between.

A curved guide stop 170 is either formed on or mounted onto the outer surface 139 of the cylindrical wall 137 at a predetermined distance from the dispensing slot 140. The curved guide stop 170 includes an upper end 171 having a guide slot 172 for the passage of the free end 152 of the strap material 150 and a lower end 174 secured to the outer surface 139 of the cylindrical wall 137.

Figure 10:
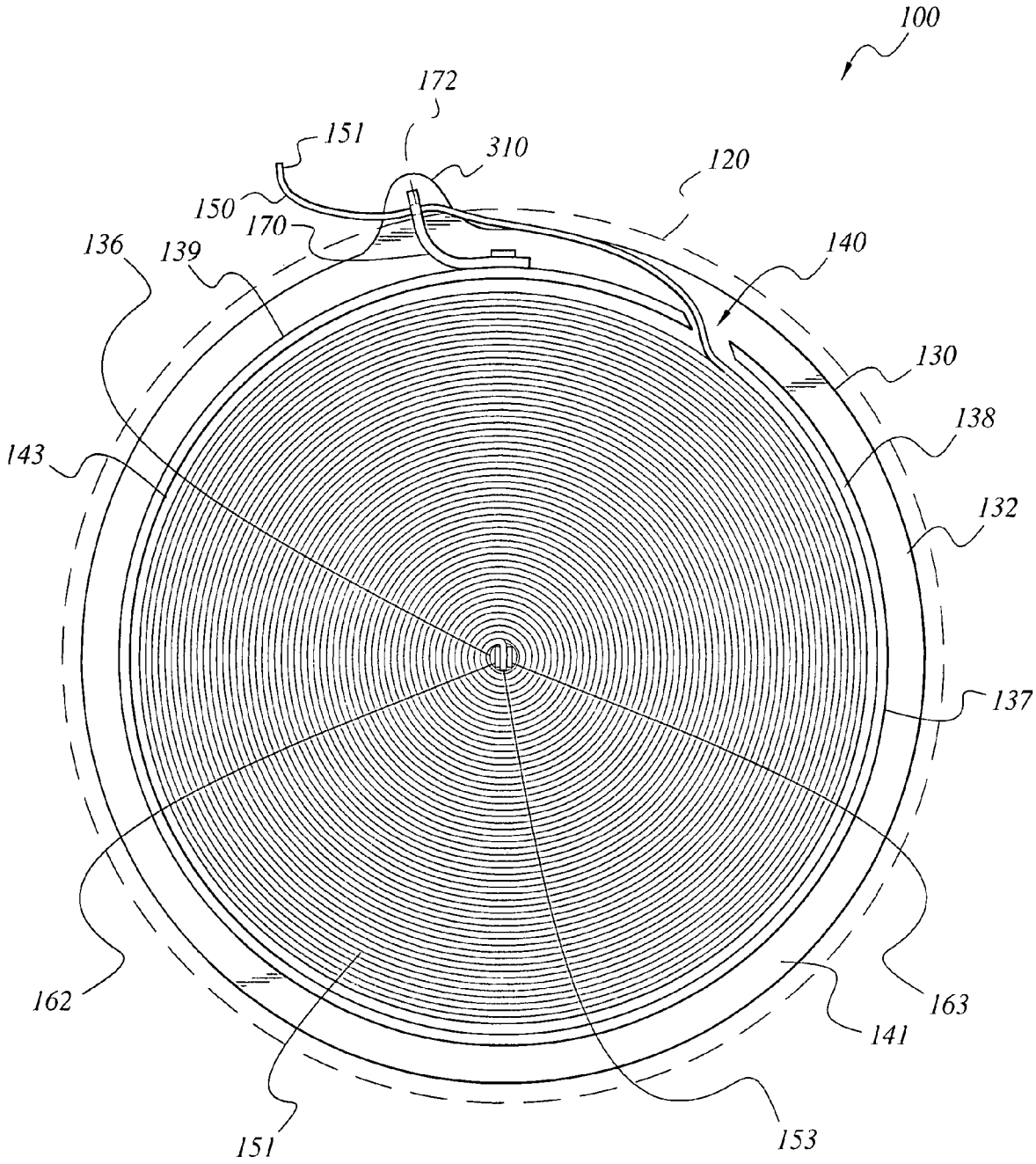
FIG. 10 is a top view in section, similar to FIG. 3, of an alternative embodiment of the utility strap dispenser according to the present invention.
Figure 11:
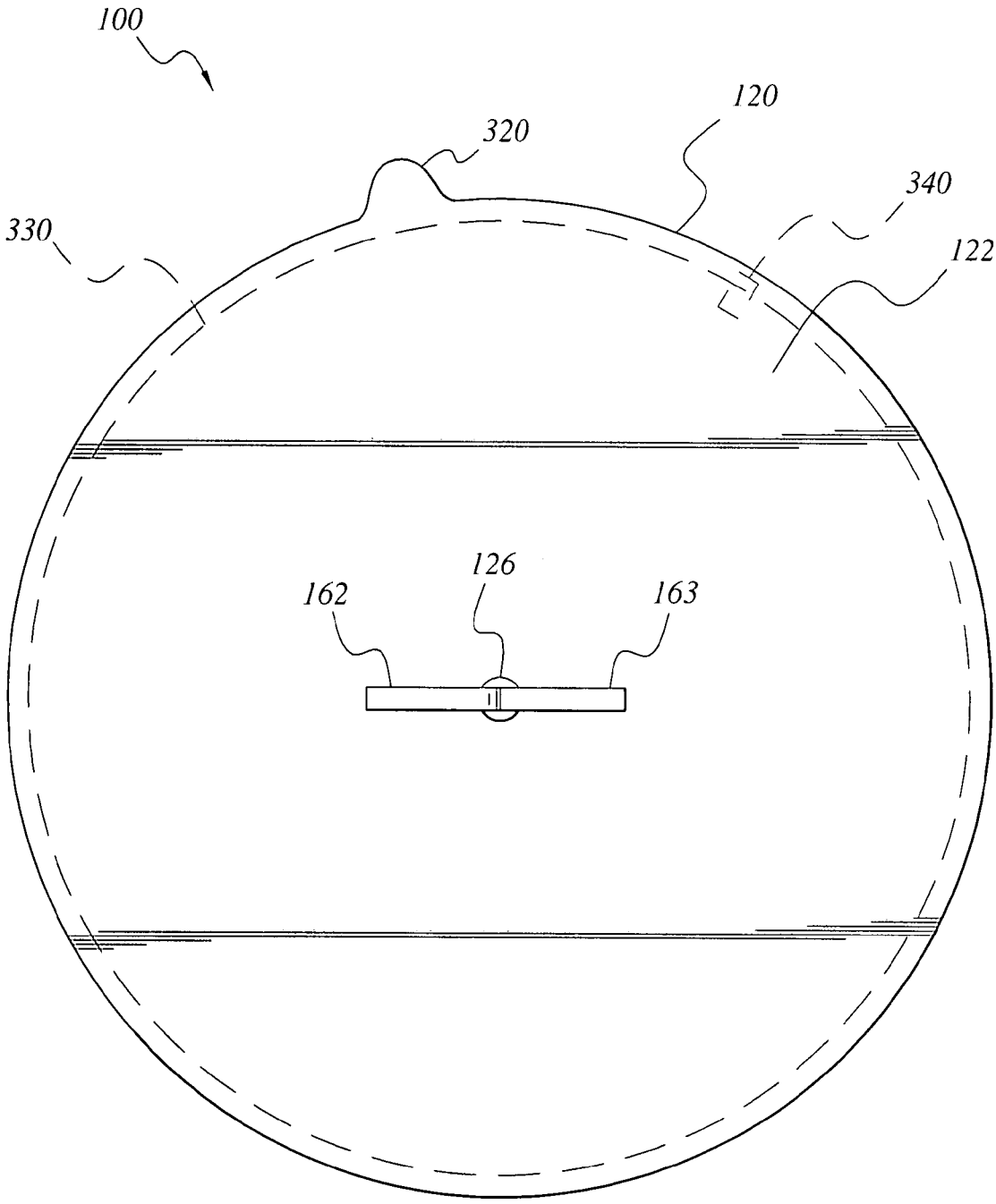
FIG. 11 is a top view, similar to FIG. 5, of an alternative embodiment of the utility strap dispenser according to the present invention.

In an alternative embodiment, illustrated in FIGS. 10 and 11, the container 100 may include a protective bulge of reinforcing and supporting material extending from the periphery of the top plate 120 and the bottom plate 130 adjacent to the guide stop 170 so that the end portion of the guide stop 170 is sandwiched between two supporting protective bulges 310, 320, respectively joined to, or formed on or by, bottom and top plates 130, 120. It should be understood that protective bulges 310, 320 may have any dimension or configuration that extends beyond the guide stop 170, and that the supporting plates shown in the drawings are shown for exemplary purposes only. The angular position of the guide stop 170 may be varied, depending upon the nature of the coiled strap 150 material and the needs of a particular user.

When the free end 152 of strap material 150 is held and the container 100 is allowed to fall free under the force of gravity, the strap material 150 frictionally binds itself in the guide slot 172 of the guide stop 170 so that the container 100 may be suspended by the free end 152 of the strap material without releasing any of the remaining strap 150 from the coil 151 within container 100. FIG. 1 shows a strap material 150 being used as a temporary support. The free end 152 of strap material 150 is anchored to one side of an object, and the strap material 150 is looped under the object and anchored. As shown in FIG. 1, the container 100 can be released to free one's hands for other uses. After the temporary use, the dispensed amount of strap material 150 can be rewound into container 100 using the bent portions of legs 162 and 163 of split pin 160, preventing waste. In the case of split pin 200, the handle 21 & is used to rewind the strap material 150.

The container 100 can be fabricated from 21-28 gauge light sheet metal or injection-molded using a suitable sturdy plastic material. When container 100 is formed from sheet metal, the curved plastic guide stop 170 is secured to the container wall 137 with suitable fastener elements, such as rivets 176, best seen in FIG. 4.

Figure 6:
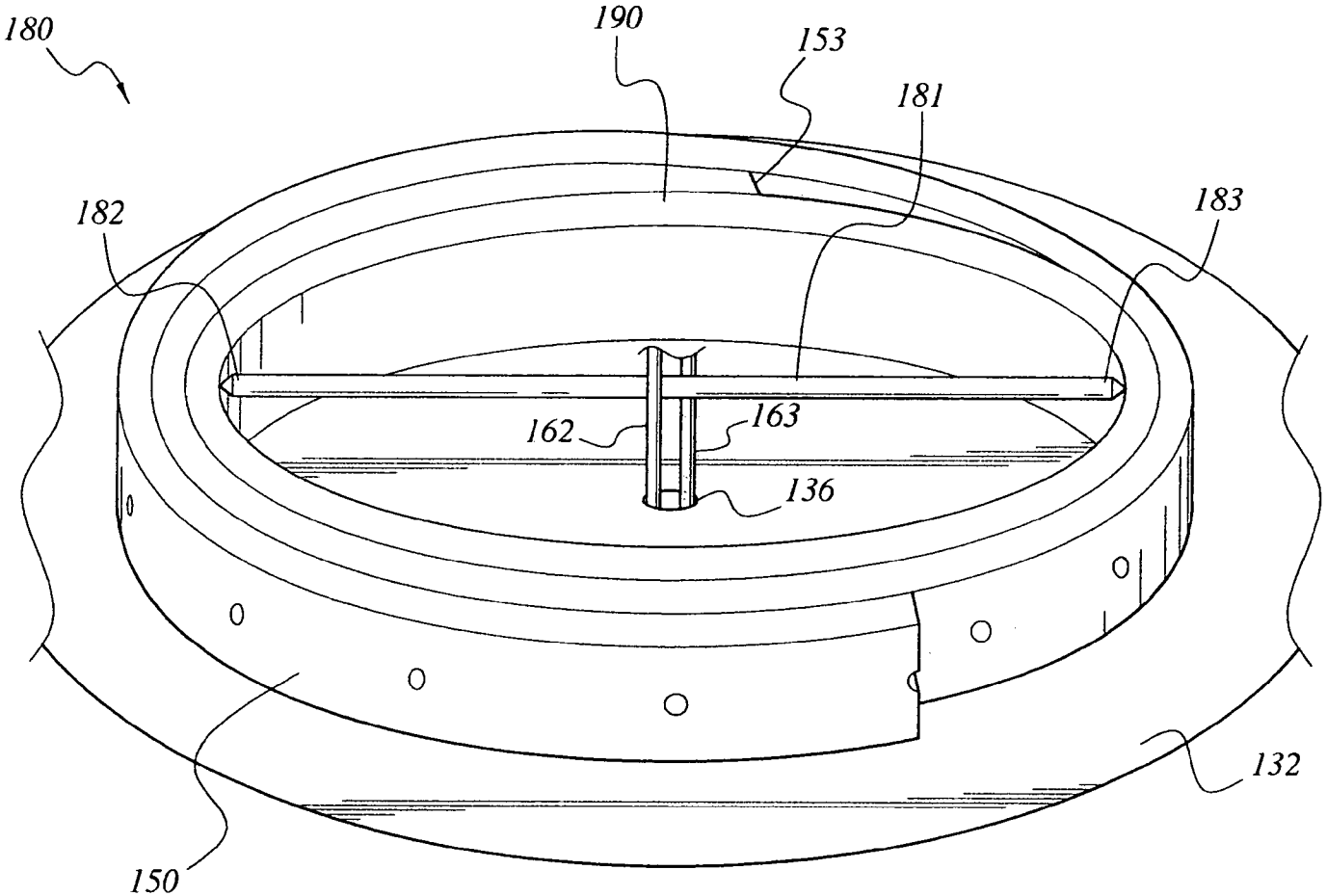
FIG. 6 is a perspective view a spin pin mounted above the bottom plate of the utility strap dispenser according to the present invention engaging an inner wall of a coil-mounting ring.

Turning now to FIG. 6, to enable the use of coils of strap material wound upon a cardboard ring 190 and the like, a spin pin 180 is provided. Spin pin 180 is preferably provided in the form of an elongated rod 181 having a first sharpened end 182 and a second sharpened end 183. The length of the spin pin 180 is selected to be slightly greater than the inner diameter of the particular ring 1 90 the strap material 150 is wound upon so that the sharpened ends penetrate the inner surface of ring 190. First leg 162 and second leg 163 of split pin 160 (or legs 206 and 208 of split pin 200) straddle the spin pin 180 in the coil-receiving chamber 143 to impart rotational movement to the coil 151.

In order to keep track of the supply of strap material 150 within container 100, the bottom plate 130 is also provided with depletion indicator openings 131, 133 and 135 arranged about the central aperture 136. Indicator openings 131, 133 and 135, respectively, provide sequential indications of the amount of strap material 150 remaining in the container 100.

Further, as best shown in the embodiment of FIG. 11, an annular lip or rim 330 may be formed on the bottom surface of top plate 120. The annular lip or rim 330 has a slightly smaller diameter than wall 137 in order to fit inside wall 137 and prevent sliding movement of top plate 120 relative to the bottom plate 130, keeping proper alignment thereof. Tab 340 may also be formed on the bottom surface of top plate 120, with the tab 340 engaging slot 140 in order to prevent rotation of top plate 120. Additionally, it should be noted that container 100 is preferably portable, and may include a belt clip, allowing the container 100 to be easily transported by the user.

It is to be understood that the present invention is not limited to the embodiments described above, but encompasses any and all embodiments within the scope of the following claims.

I claim:

1. A utility strap dispenser for storing and dispensing strap material formed in a coil, comprising:

a round top plate having a top surface, a bottom surface, and a central aperture;

a round bottom plate having an upper surface, a bottom surface and a central aperture;

a cylindrical wall extending concentrically around the bottom plate, the bottom plate and the cylindrical wall defining a coil-receiving chamber, a portion of the bottom plate extending beyond the cylindrical wall defining a peripheral flange, the cylindrical wall having an outer surface and having a dispensing slot defined therein for the passage of the strap material therethrough;

a curved guide stop having an upper end and a lower end, the upper end defining a guide slot for the passage of strap material therethrough, the lower end being affixed onto the outer surface of the wall at a predetermined distance from the dispensing slot; and a plastic split pin having a head larger than the central apertures and a shaft extending from the head, the shaft being split and forming a first leg and a second leg extending from the head, the legs being extended through the central apertures of the top and bottom plates, the legs being adapted for straddling an end of the coil of strap material in order to rotate the coil within the coil-receiving chamber.

2. The utility strap dispenser according to claim 1, wherein said split pin is made from injection molded plastic.

3. The utility strap dispenser according to claim 1, further comprising an arcuate ridge disposed on each of the legs of said split pin adjacent the head of said split pin, the ridges forming an interference fit with the bottom plate in order to retain said split pin on said bottom plate, the legs being inserted through the central aperture of said bottom plate.

4. The utility strap dispenser according to claim 1, wherein said split pin has an annular groove defined therein adjacent an end of the shaft distal from the head, the groove defining a lower shoulder preventing further progress of said top plate into the coil-receiving chamber and an upper shoulder keeping the top plate attached to said pin for covering the coil of strap material disposed in the coil-receiving chamber.

5. The utility strap dispenser according to claim 4, wherein said legs are resilient, said legs being compressible towards one another for passage through the apertures in the top and bottom plates, the legs expanding away from one another to keep said top plate attached to said bottom plate.

6. The utility strap dispenser according to claim 1, wherein said split pin is made from plastic, said split pin having:

an arcuate ridge disposed on each of the legs of said split pin adjacent the head of said split pin, the ridges forming an interference fit with the bottom plate in order to retain said split pin on said bottom plate, the legs being inserted through the central aperture of said bottom plate; and an annular groove defined therein adjacent an end of the shaft distal from the head, the groove defining a lower shoulder preventing further progress of said top plate into the coil-receiving chamber and an upper shoulder keeping the top plate attached to said pin for covering the coil of strap material disposed in the coil-receiving chamber, said legs being resilient, said legs being compressible towards one another for passage through the apertures in the top and bottom plates, the legs expanding away from one another to keep said top plate attached to said bottom plate.

7. The utility strap dispenser according to claim 1, further comprising a handle disposed on the head of said split pin for rotating said split pin and the coil of strap material disposed in said coil-receiving chamber.

8. The utility strap dispenser according to claim 7, wherein said handle extends diametrically across the entire head of said split pin.

9. The utility strap dispenser according to claim 1, further comprising a spin pin, the spin pin being an elongated rod having a first sharpened end and a second sharpened end, the rod being disposed between the legs of the split pin for rotation therewith, the sharpened ends extending from either side of said split pin, the sharpened ends being adapted for engaging a ring supporting the coil of strap material.

10. The utility strap dispenser according to claim 1, wherein said top plate and said bottom plate each have a protective bulge extending from a periphery thereof, the protective bulges being aligned with said guide stop and sandwiching said guide stop therebetween.

11. The utility strap dispenser according to claim 1, further comprising a tab depending from said top plate, said tab engaging the slot defined in said cylindrical wall in order to prevent rotation of said top plate.

12. The utility strap dispenser according to claim 1, wherein said top plate comprises an annular lip projecting from the bottom surface of said top plate, the annular lip having a diameter slightly smaller than said cylindrical wall and nesting inside said cylindrical wall in order to prevent sliding movement of said top plate relative to said bottom plate.

* * * * *